US007247070B2

(12) United States Patent
Boice

(10) Patent No.: US 7,247,070 B2
(45) Date of Patent: Jul. 24, 2007

(54) PORTABLE ICE RESCUE CRAFT

(76) Inventor: Steven D. Boice, 9682 Brownsville Hwy. NE., Bremerton, WA (US) 98311

( * ) Notice: Subject to any disclaimer, the term of this patent is extended or adjusted under 35 U.S.C. 154(b) by 269 days.

(21) Appl. No.: 11/039,974

(22) Filed: Jan. 21, 2005

(65) Prior Publication Data

US 2005/0164575 A1 Jul. 28, 2005

Related U.S. Application Data

(60) Provisional application No. 60/538,636, filed on Jan. 22, 2004.

(51) Int. Cl.
*B63C 9/32* (2006.01)

(52) U.S. Cl. ..... 441/82; 440/90

(58) Field of Classification Search ..... 114/353; 440/12.5–12.7, 90–93, 98–100; 441/82; 180/196

See application file for complete search history.

(56) References Cited

U.S. PATENT DOCUMENTS 1,905,162 A * 4/1933 Ensenat ..... 440/90
3,371,637 A * 3/1968 Woodall ..... 114/58
5,248,271 A * 9/1993 Chu ..... 440/90
5,807,153 A 9/1998 Allen et al.
7,137,350 B2 * 11/2006 Waldock ..... 114/362

* cited by examiner

*Primary Examiner*—Ed Swinehart
(74) *Attorney, Agent, or Firm*—Robert R. Richardson, P.S.

(57) ABSTRACT

A portable ice rescue craft includes a plurality of locking raft sections that are foldable for storage and transport. A drive unit includes a drive wheel driven by an electric motor via a drive belt. The drive wheel may include a plurality of spikes configured to engage ice and a plurality of paddles that are centripetally urgeable outward to pull the rescue craft through water. A forward raft section may include a pair of outboard pontoons to provide stability and minimize lateral rocking. An aft raft section includes at least one rudder. A pair of rudders may be mounted to a plate on a pivoting, biased system. The rudders automatically fold upwardly when the ice rescue craft is on ice or land. The rudders automatically activate downwardly when the ice rescue craft is in water.

16 Claims, 11 Drawing Sheets

16
58
60
94
92
90
88
82
84
77
81
79
86
80
76
78
100
104
108
112
102
98
106
110
114
74
66
$a_3$
$a_4$
20
62
64
68
70
22
72

PORTABLE ICE RESCUE CRAFT

CROSS-REFERENCE TO RELATED APPLICATIONS

This Application is a Non-Prov of Prov (35 USC 119(e)) application No. 60/538,636 filed on Jan. 22, 2004.

FIELD OF THE INVENTION

This invention relates generally to rescue craft and, more specifically, to ice rescue craft.

BACKGROUND OF THE INVENTION

Rescuing a victim who has fallen through ice presents many challenges to a would-be rescuer. For example, often the victim is beyond reach of a person standing at an edge of the ice. In such a case, an attempt may be made to throw a rescue aid, such as a rope or a life ring attached to a rope, to the victim. For this rescue technique to be effective, not only must the victim be within reach of the rope, but additionally the rescue aid must be thrown accurately to the victim. Often, both of these criteria are not met.

When the victim is beyond reach of the rope, the rescue aid or a rescuer must be brought onto the ice toward the victim. If the rescuer merely ventures onto the ice through which the victim has fallen, the rescuer may also likely fall through the ice—thereby becoming an additional victim in need of rescue. In addition, in some circumstances the rescuer may have to traverse land, snow, water, broken ice and water, ice, or any combination thereof, to reach the victim.

Attempts have been made to make crafts to bring a rescuer onto the ice toward a victim who has fallen through the ice. For example, U.S. Pat. No. 5,807,153 (the '153 patent) discloses a rescue vehicle that has a buoyant hollow sled pulled behind a traction wheel that includes a plastic, buoyant, rotating drum. The drum has a number of fins to propel the vehicle in water. Mounted to the fins are three annular rings having tangs for traction on ice. An internal combustion engine provides power to turn the drum via two gear belt drives on each side of the drum. Handle bars are used to steer the vehicle, and a throttle control, similar to those used on motorcycles, provides the rescuer with a means to control the engine and vehicle speed.

Unfortunately, the sled of the '153 patent is too small to accommodate both the rescuer and the victim. Thus, the rescuer must lay prone with legs extending past a rear end of the sled while operating the rescue vehicle. This could subject the rescuer to undue danger if the rescue vehicle must be operated over land. Further, the internal combustion engine is very heavy. Therefore, probability is increased of breaking up ice by the rescue vehicle itself. If this were to happen, then the legs of the rescuer would be immersed in a combination of broken ice and frigid water. Moreover, the internal combustion engine requires heavy gearing to reduce rotation of the drum to speeds slow enough to be usable in water and on ice. This additional weight of the heavy gearing further increases probability of the rescue craft breaking up the ice.

As a result, there is an unmet need in the art for a rescue vehicle that is lightweight, easily transportable, compact, and provides a platform that protects both the rescuer and the victim from ice and water.

SUMMARY OF THE INVENTION

Embodiments of the present invention provide a portable ice rescue craft. The portable ice rescue craft is compact, lightweight, foldable for easy transport, and provides a platform that protects both the rescuer and the victim from ice and water.

An exemplary portable ice rescue craft according to an embodiment of the present invention includes a plurality of locking raft sections that are foldable for storage and transport. A drive unit includes a drive wheel driven by an electric motor via a drive belt. The drive unit may include a pair of outboard pontoons to provide stability and minimize lateral rocking. An aft raft section includes at least one rudder. If desired, a forward raft section may be interposeable between the drive unit and the aft raft section.

According to an aspect of the present invention, the drive wheel includes a plurality of spikes configured to engage ice and a plurality of paddles that are centripetally urgeable outward to pull the rescue craft through water.

According to another aspect of the present invention, a pair of rudders may be provided outboard an after portion of the aft raft section. The pair of rudders may be mounted to a plate on a pivoting, biased system. Advantageously, the rudders are active when the ice rescue craft is in water. The rudders automatically fold upwardly when the ice rescue craft is on ice or land. The rudders automatically activate downwardly when the ice rescue craft is in water.

DETAILED DESCRIPTION OF THE INVENTION

Figure 1:
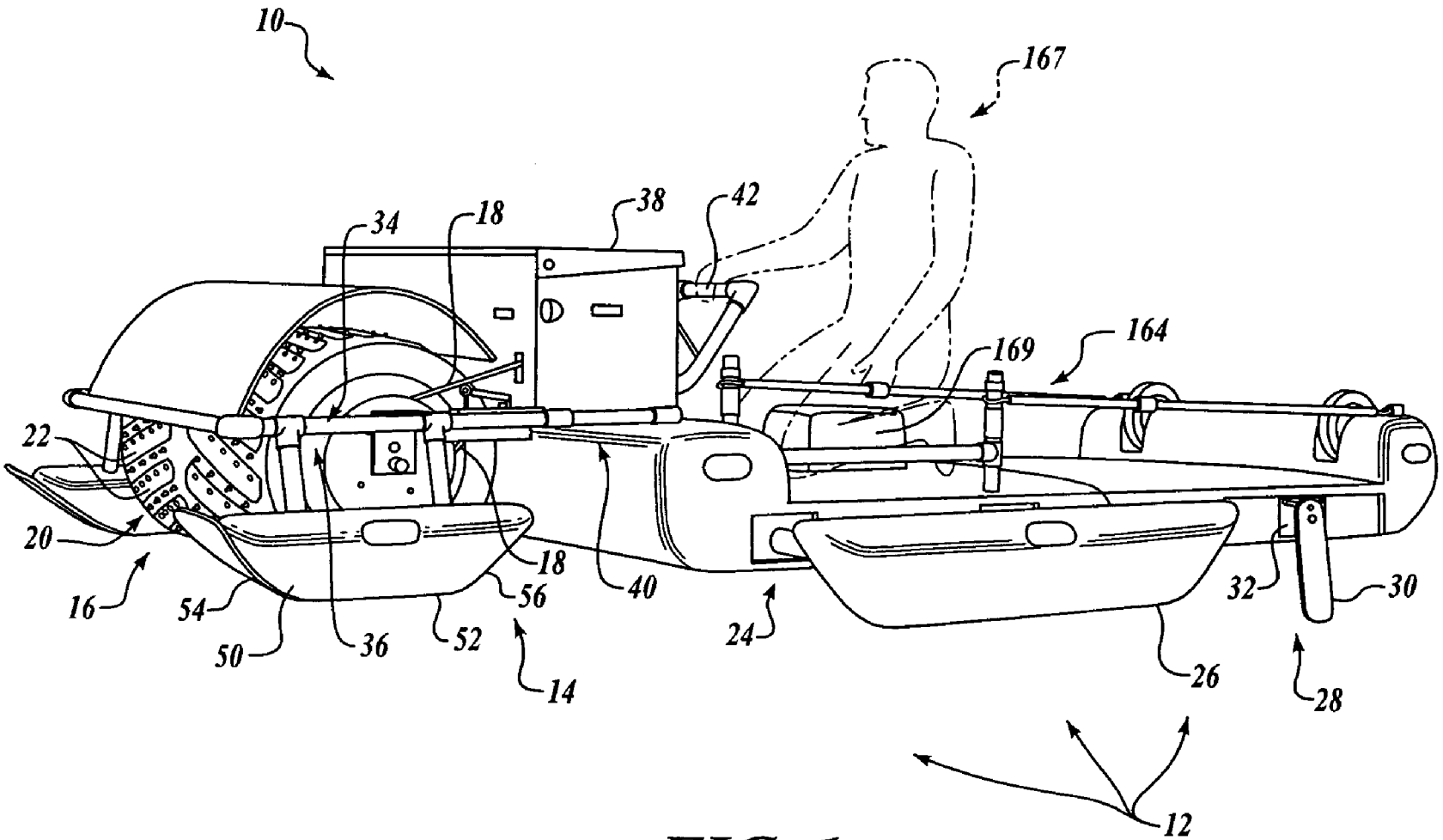
FIGS. 1, 2, and 3 are perspective views of a portable ice rescue craft according to an embodiment of the present invention in a configuration ready for use.
Figure 2:
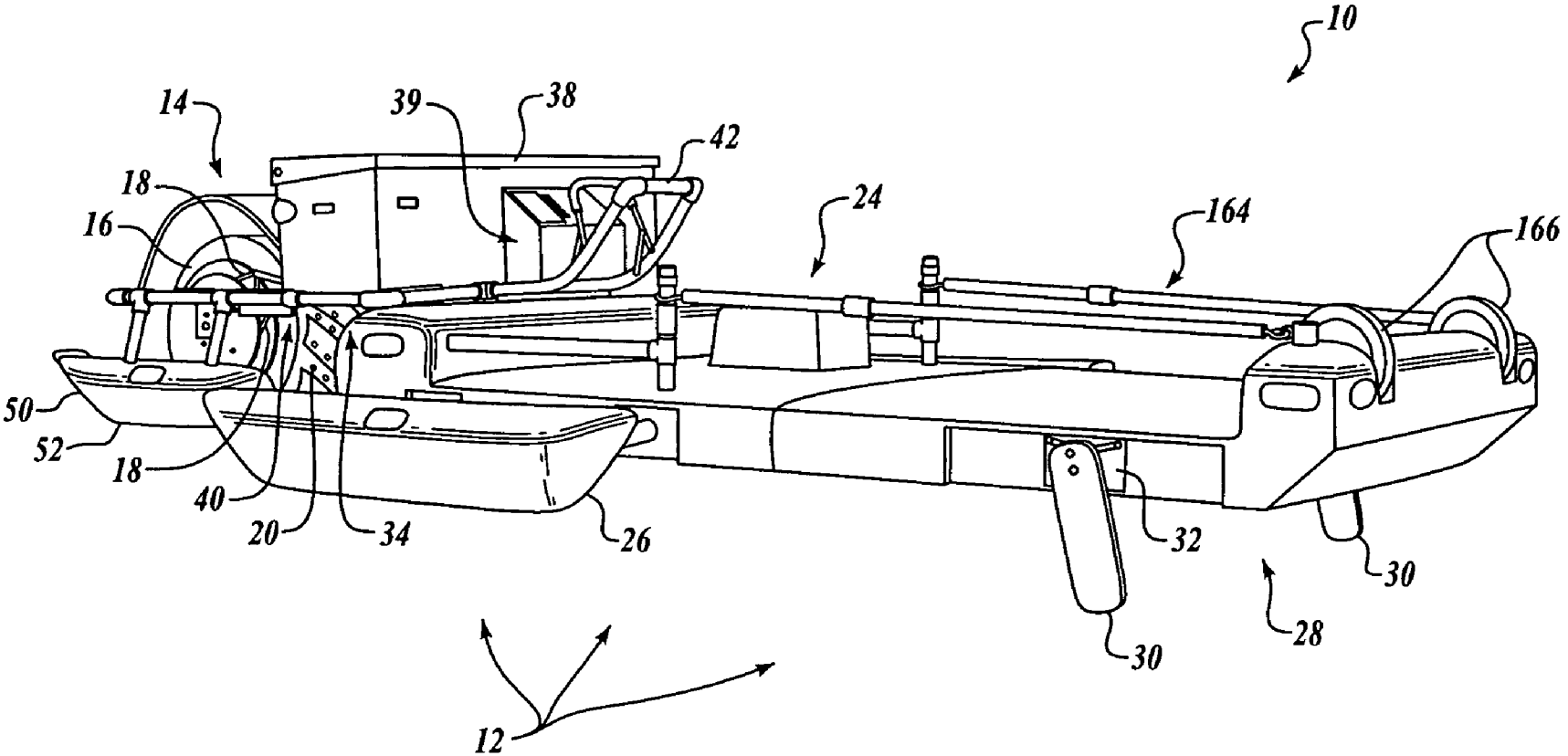
Figure 3:
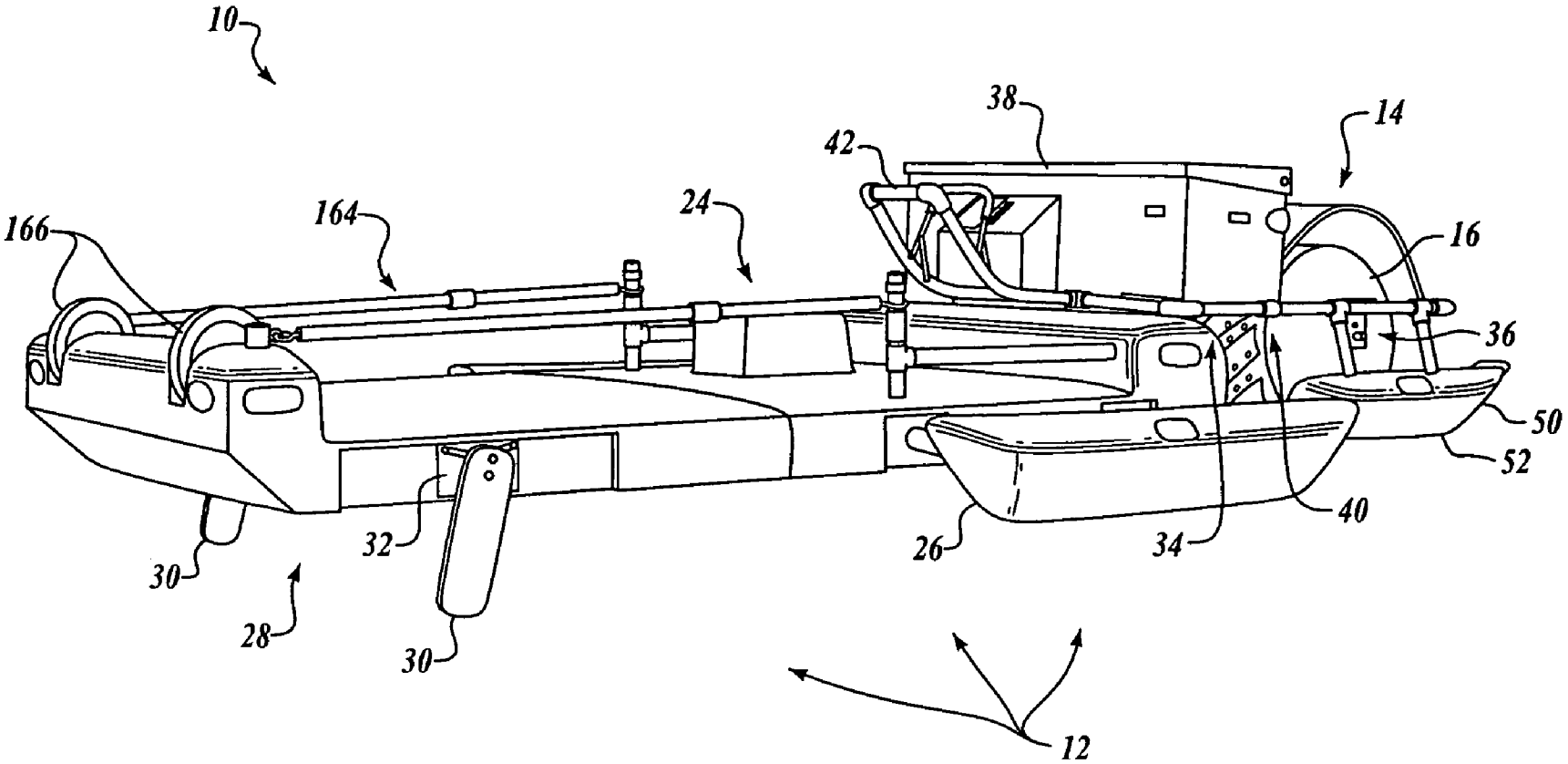
Figure 4:
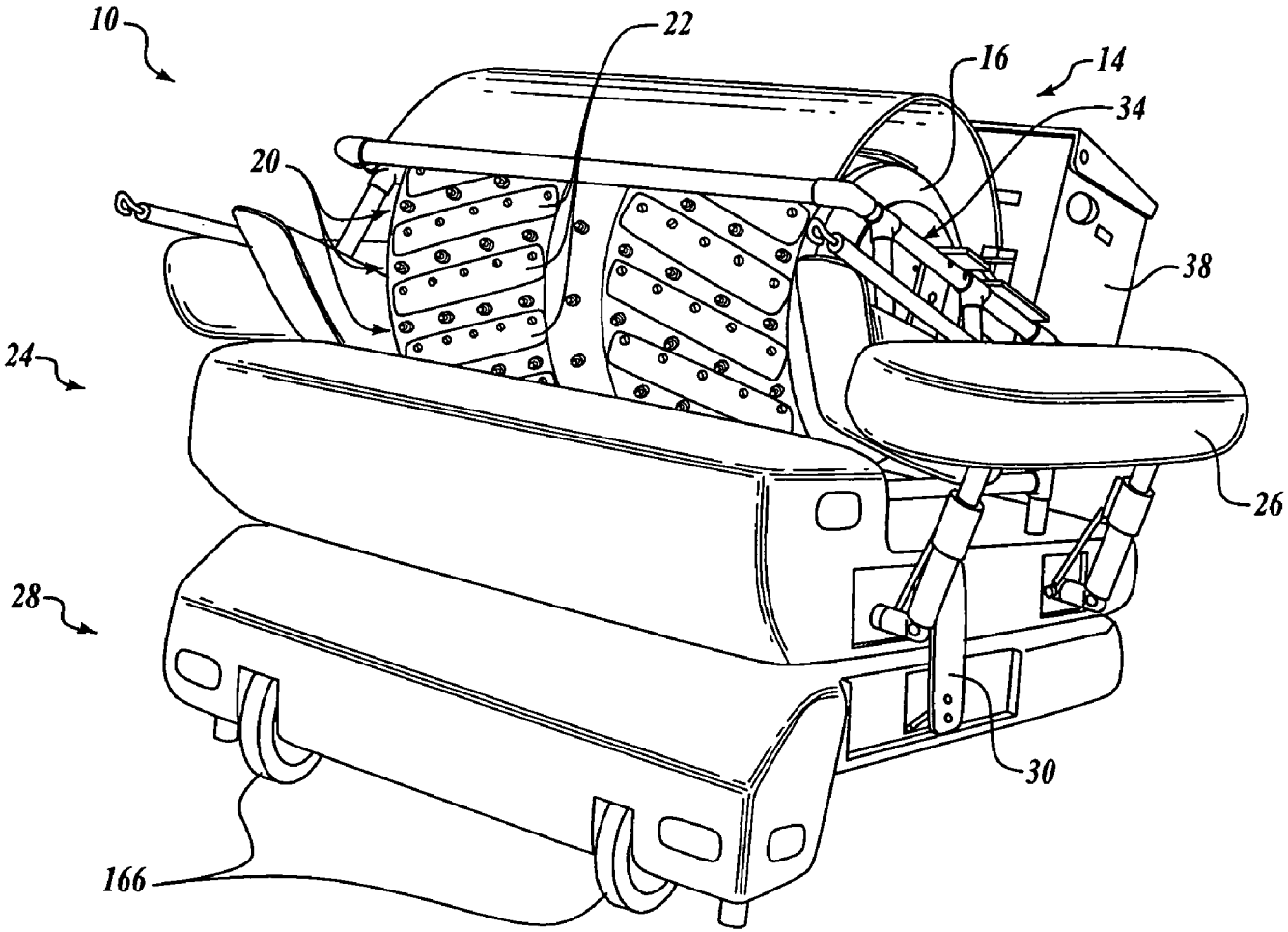
FIGS. 4 and 5 are perspective views of the rescue craft of FIGS. 1–3 folded in a configuration for transport.

By way of overview and referring to FIGS. 1–3, embodiments of the present invention provide a portable ice rescue craft 10 that is compact, lightweight, foldable for easy transport, and provides a platform that protects both the rescuer and the victim from ice and water. An exemplary portable ice rescue craft 10 according to an embodiment of the present invention includes a plurality of locking raft sections 12 that are foldable for storage and transport. A drive unit 14 includes a drive wheel 16 driven by an electric motor (not shown) via a drive belt 18. The drive wheel 16 may include a plurality of spikes 20 configured to engage ice and a plurality of paddles 22 that are centripetally urgeable outward to pull the rescue craft 10 through water. A forward raft section 24 may include a pair of outboard pontoons 26 to provide stability and minimize lateral rocking. An aft raft section 28 includes at least one rudder 30. A pair of the rudders 30 may be mounted to a plate 32 on a pivoting, biased system. The rudders 30 automatically fold upwardly when the ice rescue craft 10 is on ice or land. The rudders 30 automatically activate downwardly when the ice rescue craft 10 is in water. Details of embodiments of the present invention will now be set forth below.

Referring to FIGS. 1–3 and 6, the drive unit 14 includes a frame made of a suitably lightweight and strong material, such as without limitation polyvinylchloride (PVC) pipe, aluminum pipe, or the like. The drive wheel 16 (explained in detail below) is mounted within a forward section 36 of the frame 34. A case 38 that houses a drive motor, batteries, and control and safety electronics (all discussed in detail below) is mounted on an after section 40 of the frame 34. A handle 42 for steering the drive unit 14 extends upwardly from an aft end 44 of the after section 40 of the frame 34. A spring-loaded, quick-release lock pin 46 extends downwardly from a forward, lower portion 48 of the handle 42. As will be explained below, the lock pin 46 attaches the drive unit 14 to other sections of the rescue craft 10 and permits the drive unit 14 to be rotated in azimuth relative to the other sections (that is, the forward and aft raft sections 36 and 24) of the rescue craft 10. This permits the rescue craft 10 to be steered.

Pontoons 50 are mounted on both sides of the drive unit 14 outboard the forward section 36 of the frame 34. The pontoons 50 advantageously help minimize drive wheel cavitation when the drive wheel 16 is turning and guide the drive wheel 16 during transitions between water and ice. The pontoons 50 each have an axis $a_1$ that extends fore and aft parallel to an overall fore-aft axis $a_2$ of the rescue craft 10. A bottom surface 52 of each of the pontoons 50 suitably is located higher than a lowest projection of the spikes 20. This vertical spacing helps prevent interference between the spikes 20 and the pontoons 50 when the rescue craft 10 is operating on ice. In one embodiment, the bottom surfaces 52 of the pontoons 50 are about one inch higher than the lowest projection of the spikes 20. However, the bottom surfaces 52 of the pontoons 50 may be any distance higher than the lowest projection of the spikes 20 as desired for a particular application. In one embodiment, the pontoons 50 are about two feet long, about six inches wide, and about six inches tall. Front and rear surfaces 54 and 56, respectively, of the pontoons 50 may be beveled if desired, such as around 45 degrees or any angle as desired, in order to help prevent buildup of debris under the pontoons 50.

The drive wheel 16 suitably is a cylinder that includes the spikes 20. Each spike 20 extends outwardly perpendicular from the curved surface of the drive wheel 16 for engaging ice. The cylinder also includes the paddles 22 to pull the rescue craft 10 through water. In one embodiment and referring now to FIGS. 7A and 7B, the drive wheel 16 suitably is made from two bottom-half sections 58 of industrial-type drums, such as without limitation 30 gallon drums. A strip 60 joins together the two bottom-half sections 58 and is attached to the two bottom-half sections 58 with any acceptable fasteners, such as without limitations screws. In one embodiment, the strip 60 suitably is made of plastic and has a width of about four inches. However, the strip 60 may have any width as desired for a particular application.

Figures 7A, 7B, 7C:
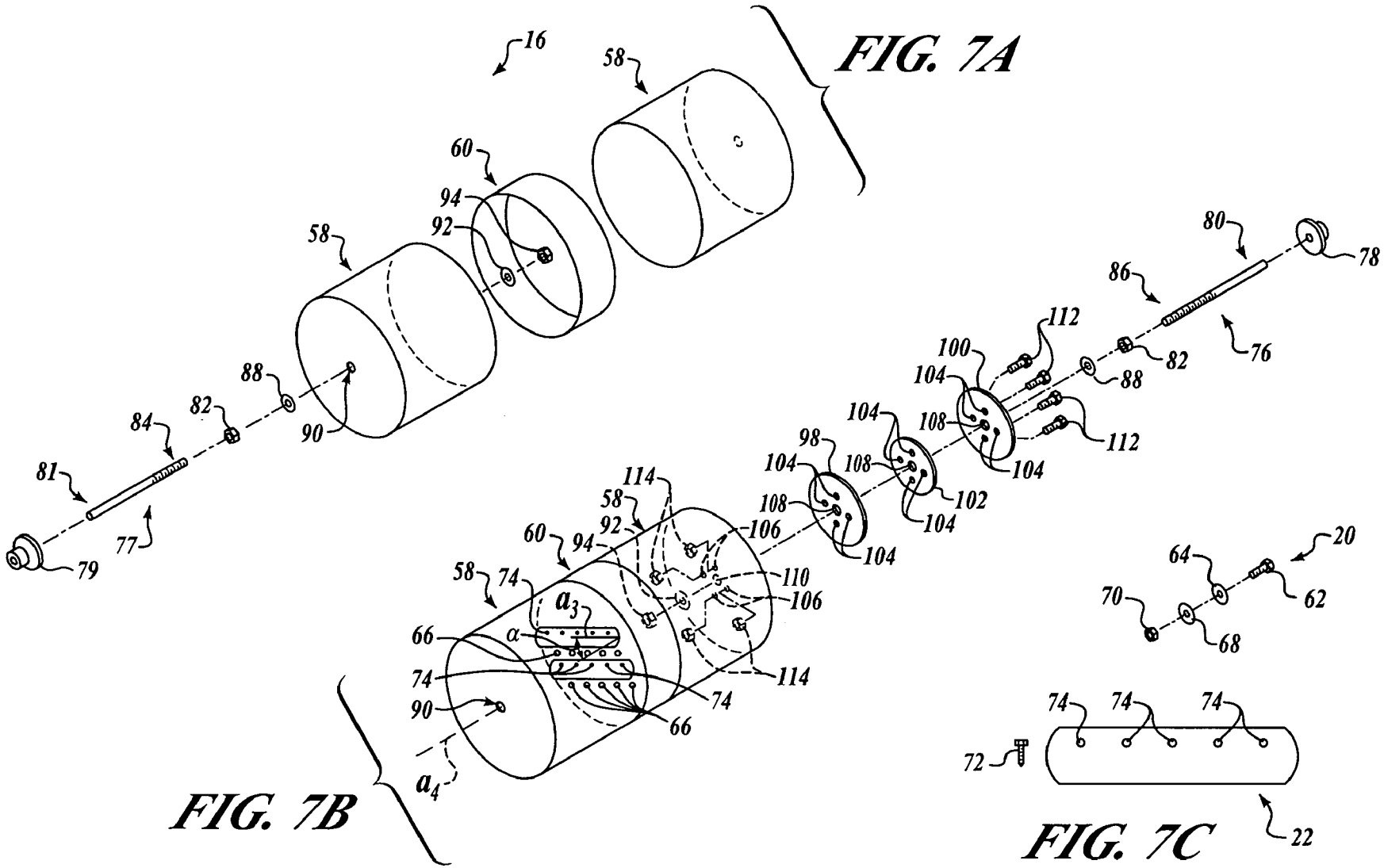

Referring now to FIGS. 7B and 7C, the spikes 20 may be any provided as any item that projects through the drive wheel 16 and engages the ice. The spikes 20 effectively engage the ice when the drive wheel 16 is driven in either a forward direction or a reverse direction. In one embodiment, the spikes 20 may be provided as screws, such as without limitation machine screws. A spike 20 (embodied as a machine screw) is installed as follows. Before the two bottom-half sections 58 are joined via the strip 60, a threaded shaft 62 of the screw is inserted through a washer 64 and through a hole 66 in the wall of one of the two bottom-half sections 58 from the inside of the bottom-half section 58. A washer 68 is placed over the threaded shaft 62 against the outside of the bottom-half section 58, and a nut 70 is threaded onto the threaded shaft 62 and tightened.

Still referring to FIGS. 7B and 7C, the paddles 22 suitably are substantially rectangular (with rounded ends, if desired) strips of rubber sheeting that are mounted to the exterior curved surface of the drive wheel 16 for propelling the rescue craft 10 through water. The paddles suitably are mounted at an angle $\alpha$, such as around twenty degrees or so, between a longitudinal axis $a_3$ of the paddle 22 and a longitudinal axis $a_4$ of the drive wheel 16. Screws 72, such as wood screws, are inserted through holes 74 located along an upper long edge in each paddle 22 and through the wall of the drive wheel 16. This mounting configuration permits the paddles 22 to be urged outwardly by centripetal force when the drive wheel 16 is in forward motion. Once urged outward, the paddles 22 frictionally engage water and pull the rescue craft 10 through the water. Advantageously, the paddles 22 lie flat against the drive wheel 16 when the rescue craft 10 is operated on ice or land.

Figure 6:
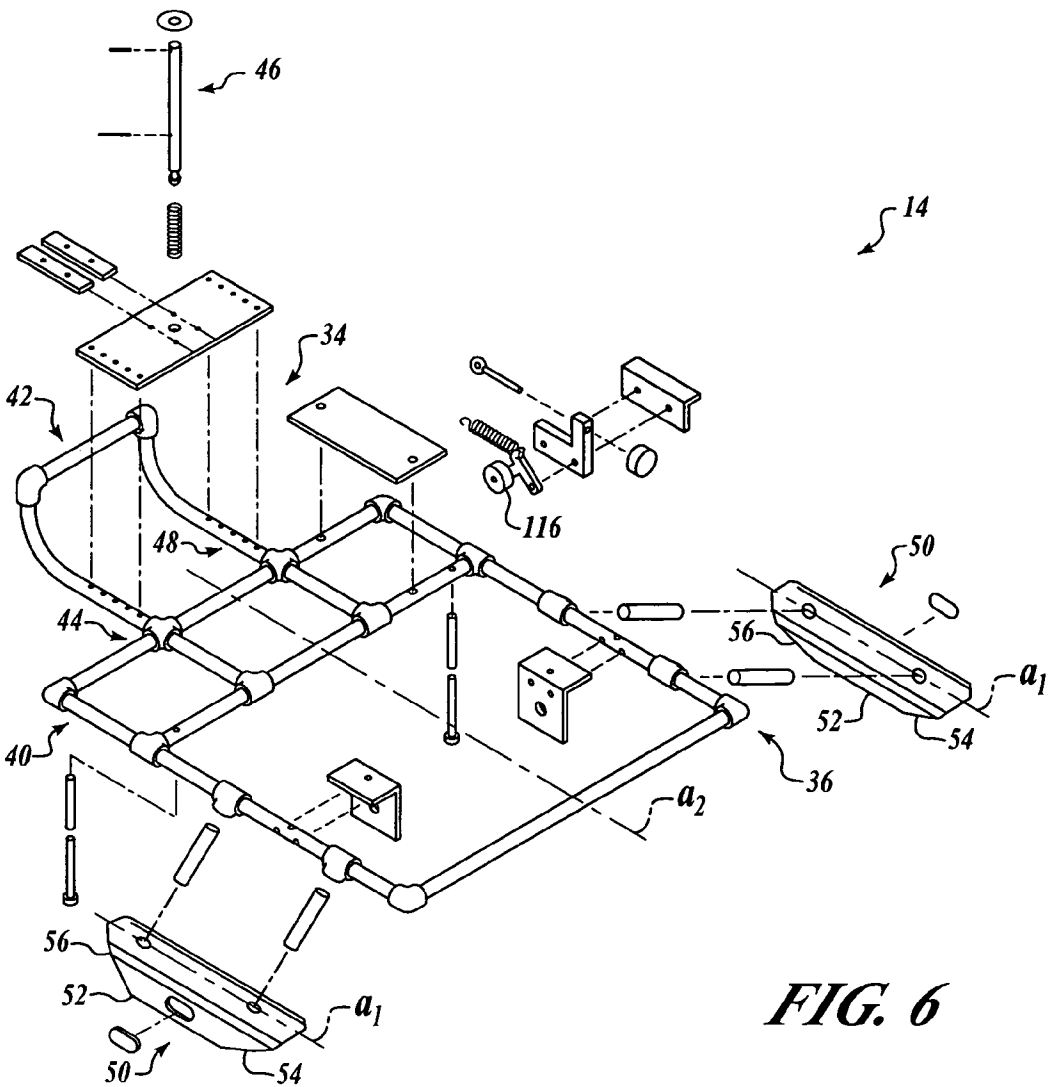
FIGS. 6, 7A–7C, and 8–11 are exploded perspective views of assembly details of components of the rescue craft of FIGS. 1–3.

Referring now to FIGS. 7A and B, the drive wheel 16 is mounted on axles 76 and 77 that support the drive wheel 16 on the forward section 36 of the frame 34 (FIG. 6). Collar bushings 78 and 79 are mounted on outboard ends 80 and 81 of the axles 76 and 77, respectively. Nuts 82 are threaded on inboard ends 84 and 86 of the axles 76 and 77, respectively, and washers 88 are placed on the axles 76 and 77. Referring to FIG. 7A, the inboard end 84 of the axle 77 is inserted through a hole 90 in one of the bottom-half sections 58. A washer 92 and a nut 94 are placed onto the inboard end 84 of the axle 77 from the interior of the bottom-half section 58, thereby holding the axle 77 in place. Referring now to FIG. 7B, a belt drive hub 96 is attached to the exterior side of the other bottom-half section 58. In one non-limiting example, the drive belt hub 96 is made up of inboard and outboard hubs 98 and 100, respectively, and an interior hub 102 that engages the drive belt 18 (FIGS. 1 and 2). The interior hub 102 has a width suitably wider than a width of the drive belt 18 (FIGS. 1 and 2). Given by way of non-limiting example, the drive belt 18 (FIGS. 1 and 2) may be an automotive fan belt of around ⅜ inches width or the like. However, the drive belt 18 may have any width as desired for a particular application. The inboard and outboard hubs 98 and 100 each have a diameter that is greater than a diameter of the interior hub 102, thereby preventing the drive belt 18 (FIGS. 1 and 2) from slipping sideways off the interior hub 102. The hubs 98, 100, and 102 have holes 104 that line up with holes 106 (shown in phantom) in the exterior side of the bottom-half section 58. The hubs 98, 100, and 102 each have a centered hole 108 that lines up with a hole 110 centered in the exterior side of the bottom-half section 58. Threaded fasteners 112, such as machine screws or bolts or the like, are inserted through the holes 104 and 106. Nuts 114 are threaded onto the threaded fasteners 112 from the interior of the bottom-half section 58, thereby attaching the drive belt hub 96 to the exterior of the bottom-half section 58. The inboard end 86 of the axle 76 and is inserted through the holes 108 and 110. A washer 92 and a nut 94 are placed onto the end of the axle 76 from the interior of the bottom-half section 58 and a washer 88 and nut 82 are placed on the outboard end of the axle 76, thereby attaching the axle 76 to one side of the drive wheel 16. A belt, such as without limitation an automotive fan belt of around ⅜ inches width or the like, frictionally engages the exterior of the hub.

Referring back to FIGS. 1–3, the drive wheel 16 is driven by an electric motor (not shown) that is mounted with a mounting bracket (not shown) inside the case 38. The electric motor may be any acceptable motor that generates sufficient power and torque to propel the rescue craft 10. Given by way of non-limiting example, the electric motor may be an 18 volt motor, such as a drill motor like a Milwaukee 18 volt drill motor. However, any acceptable battery operated drill motors rated for 12 volts and higher may be used as desired for a particular application.

A spindle (not shown), such as without limitation a two inch spindle, is attached to the drive shaft of the electric motor. The belt frictionally engages the exterior of the spindle. The electric motor drives the drive belt 18, which in turn drives the belt drive hub 96 (FIG. 7B), thereby causing the drive wheel 16 to turn. Belt slack, if any, is taken up via an adjustable, spring-loaded wheel 116 (FIG. 6) of about a two inch diameter or so that is attached to the forward section 36 of the frame 34.

In one exemplary embodiment, electrical power for the electric motor (not shown) is provided from two direct current (DC) power sources, such as without limitation two 18-volt batteries. Given by way of non-limiting example, the batteries may be 18-volt drill batteries such as without limitation gel cell batteries or the like. Optionally, each of the batteries may be provided in its own charger. If desired, the batteries may slide and lock onto the electric motor.

The rescue craft 10 may be outfitted as desired with control and safety electronics. For example, the rescue craft 10 may be outfitted as desired with any of a video system including a video camera (which may be used underwater, if desired) and a video monitor, communications radios such as hand-held very high frequency (VHF) radios, a Global Positioning System (GPS), and lights such as headlights like Halogen headlights, emergency flashing and running lights, component box lights, and a spotlight. The control and safety electronics are powered by a main component battery, such as a 12-volt battery like a gel cell battery. Controls for any installed control and safety electronics may be provided in a control panel 39 (FIG. 2) suitably mounted aft of the case 38.

The video camera, if provided, suitably is an underwater camera for locating victims under the ice. The video camera preferably is equipped with night vision optics and electronics that enable seeing in near-or-total darkness. The video camera preferably is mounted in front of the operator to a quick-release extension pole (not shown) that is clipped to the top outside of the case 38. The pole may extend to any desirable length, such as around six feet or so. The video monitor may have a small screen, such as around a five inch screen or the like, and is mounted inside the case 38 or on the control panel 39, if desired.

Figure 8:
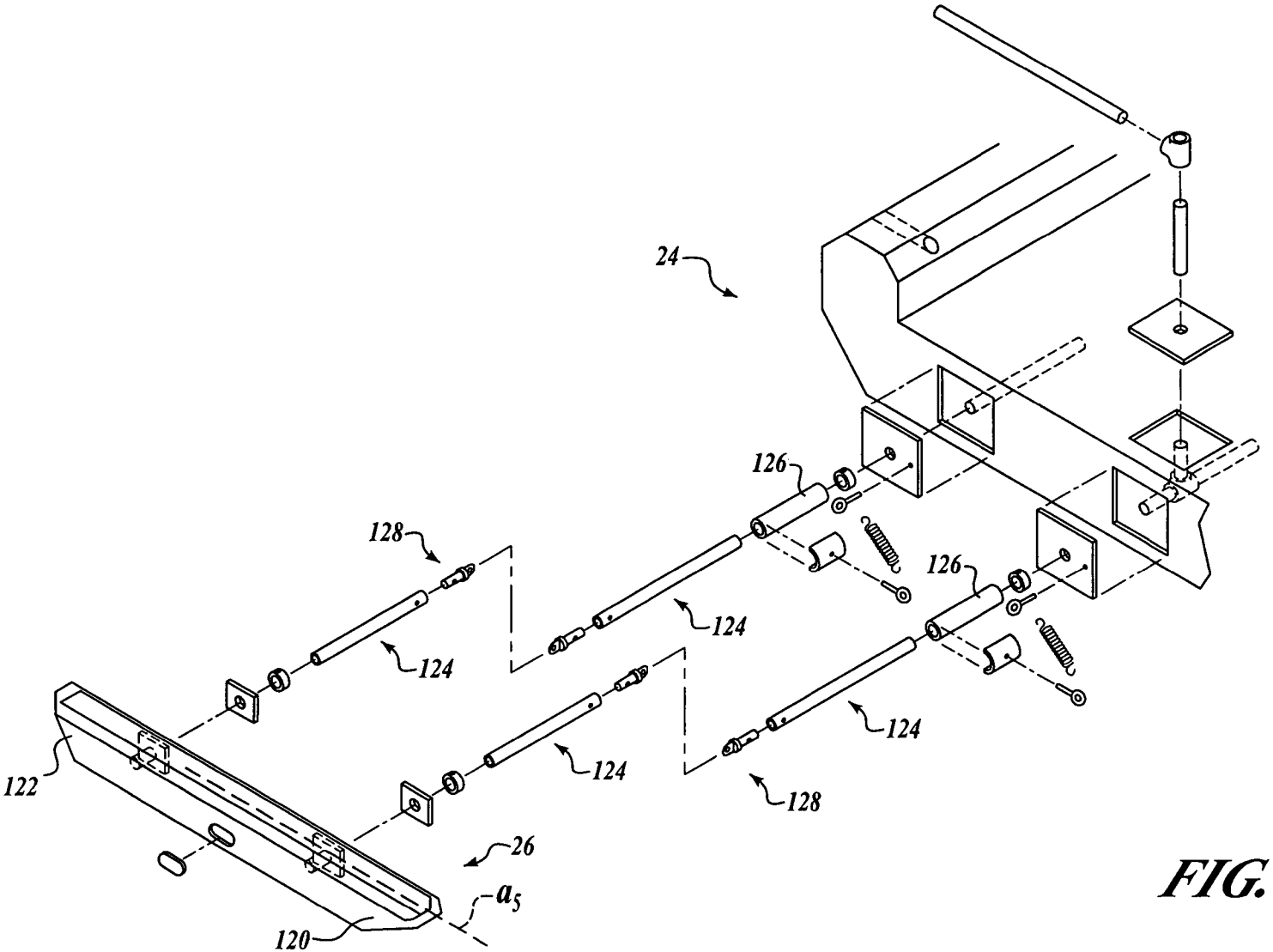

Referring additionally now to FIG. 8, the forward raft section 24 includes the outrigger pontoons 26. The outrigger pontoons 26 are mounted on both sides of the forward raft section 24 outboard a forward portion of the forward raft section 24. The outrigger pontoons 26 perform important functions. The outrigger pontoons 26 advantageously distribute weight of the rescue craft 10 while on the ice. The outrigger pontoons 26 also advantageously minimize lateral rocking during loading and unloading of rescue personnel, and provide stability while loading victims from water to the rescue craft 10. Finally, the outrigger pontoons 26 stabilize the rescue craft 10 and minimize rocking while on water, thereby enabling the operator to stand on the rescue craft 10 and attend to victims. The outrigger pontoons 26 each have an axis $a_5$ that extends fore and aft parallel to the overall fore-aft axis $a_2$ of the rescue craft 10. In one non-limiting embodiment the pontoons 26 are about four feet long, about six inches wide, and about six inches tall. Front and rear surfaces 120 and 122 of the pontoons 26 may be beveled if desired, such as around 45 degrees or any angle as desired, in order to help prevent buildup of debris under the pontoons 26. The outrigger pontoons 26 suitably are mounted on hinged arms 124 that lock into place by sliding a spring-activated tube 126 over a nylon hinge point 128.

The body of the forward raft section 24 suitably is constructed of a lightweight, strong material that helps impart positive buoyancy to the rescue craft 10. Given by way of non-limiting example, the body of the forward raft section 24 may be constructed of 2.2 closed cell poly-foam or the like. In order to increase resistance of the forward raft section 24 to damage from ice, land, debris, sharp objects, and the like, and to prevent the foam from becoming water-logged, the foam suitably is covered with a liner, such as a sprayed-on bed liner used in truck bed applications.

Figure 5:
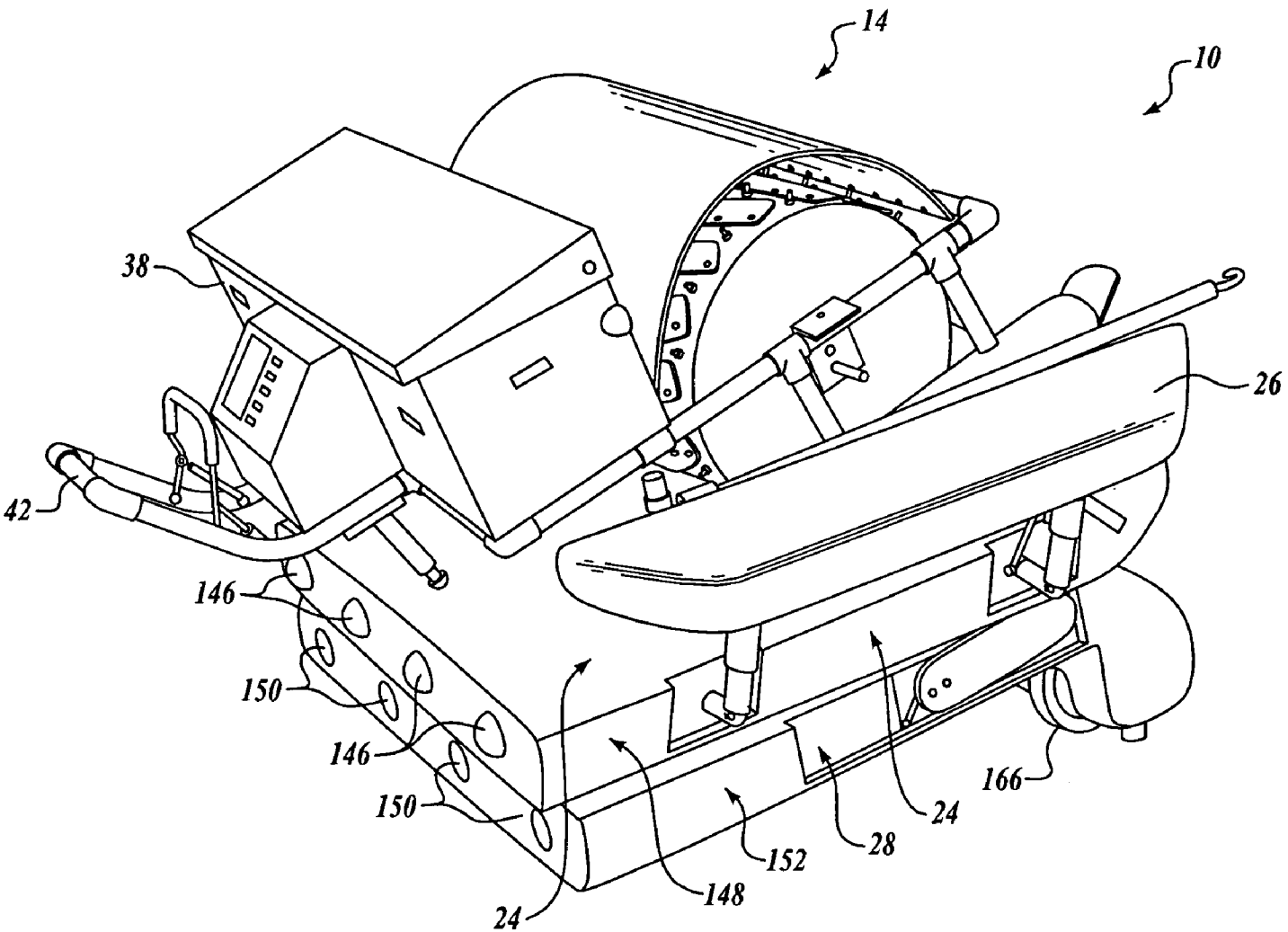
Figure 9:
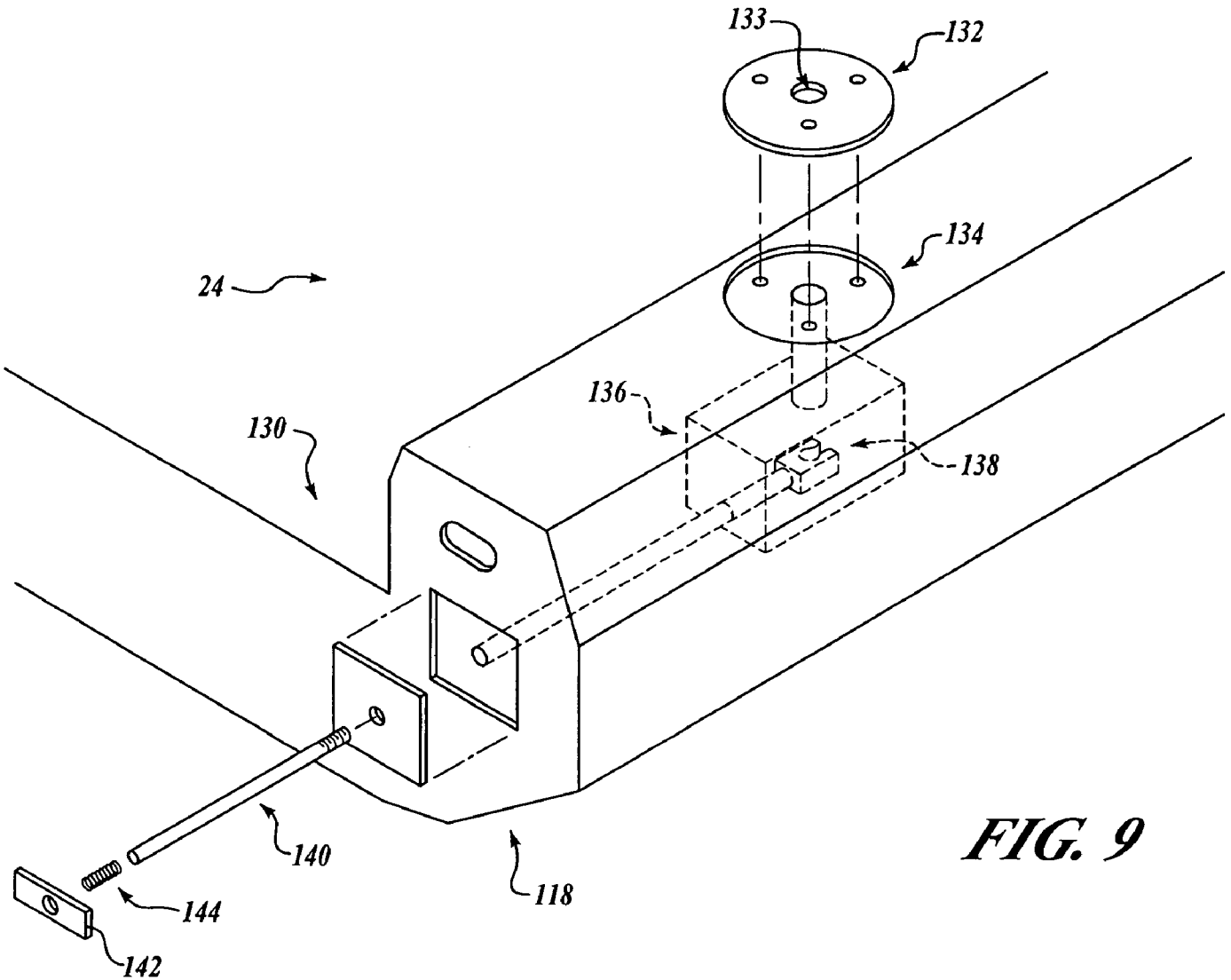

Referring now to FIGS. 5, 6, and 9, a quick release locking system 130 locks the drive unit 14 into the forward portion 118 of the forward raft section 24. A lock pin plate 132 that defines a hole 133 is mounted to a top surface 134 of the forward portion 118 of the forward raft section 24. A lock case 136 (shown in phantom) with a lock pin fork 138 is provided beneath the lock pin plate 132. A spring-loaded lock handle rod 140 extends from a side of the forward raft section 24 toward the lock pin fork 138. A handle 142 is attached to an end of the lock handle rod 140. The lock handle rod 140 is extracted to permit the lock pin 46 (FIG. 6) to be inserted down into the lock case 136. The lock handle rod 140 is released and held in place by a spring 144, thereby retaining the lock pin 46 (FIG. 6) in the lock fork 138.

Figure 10:
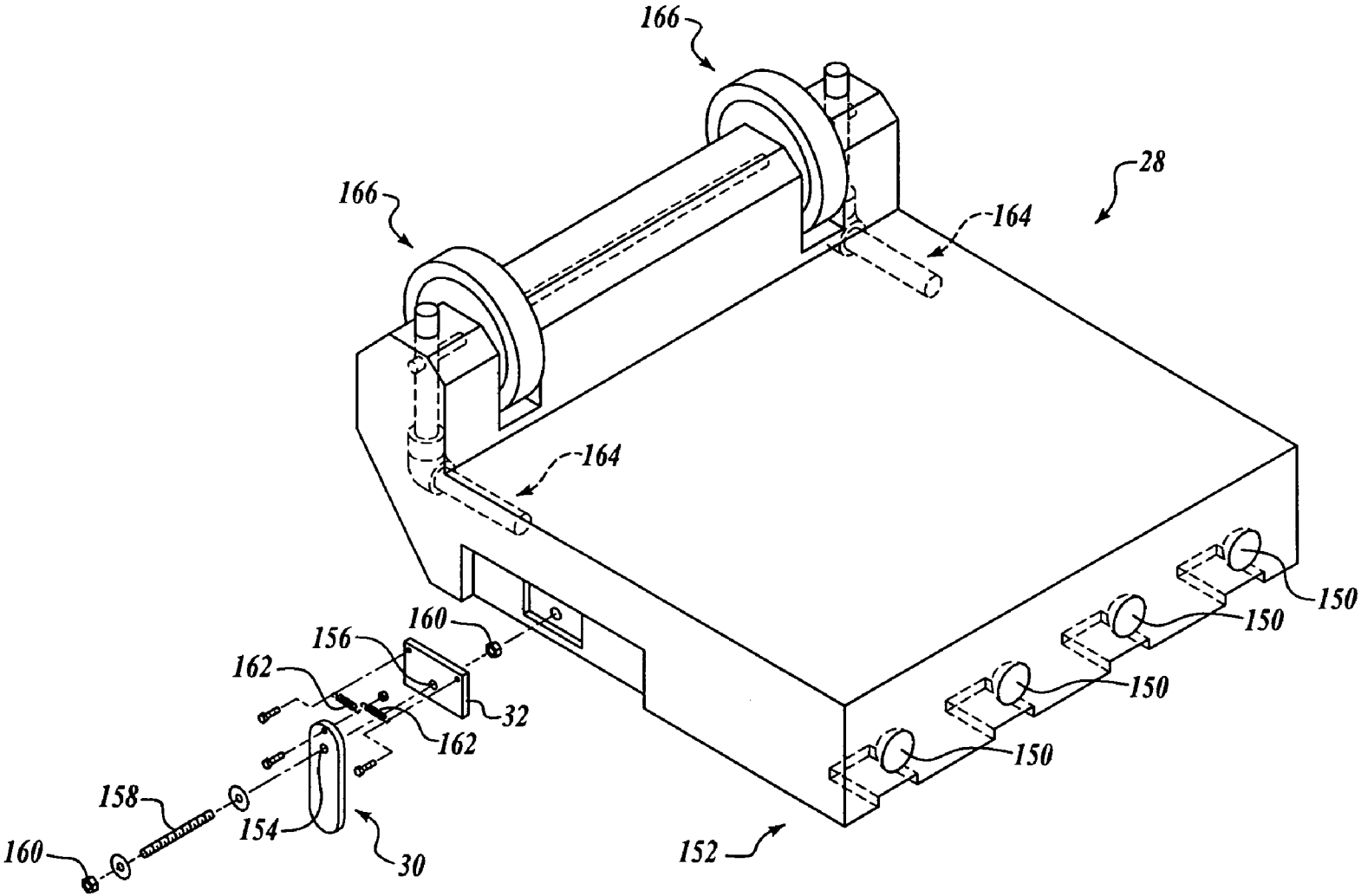

Referring now to FIGS. 5 and 10, spherical protrusions 146, like balls such as without limitation tennis balls, protrude from an after portion 148 of the forward raft section 24. The spherical protrusions 146 are rotatably receivable in concave, spherical female receptacles 150 that are defined in a forward portion 152 of the aft raft section 28.

Referring now to FIGS. 1–3 and 10, the aft raft section 28 includes the pair of rudders 30. The rudders 30 act as keels when the ice rescue craft 10 is in water. This keel-like effect permits the ice rescue craft 10 to be steered by turning the drive unit 14 with the handle 42. Each rudder 30 is mounted to the nylon plate 32 in a pivoting, biased manner. Each rudder defines a hole 154 and each plate 32 defines a hole 156. A fastener 158 is received in the holes 154 and 156 and is secured with nuts 160. The fastener 158 therefore acts as a pivot point about which the rudder 30 may pivot. Biasing members 162, such as springs; are attached to the plate 32 and the rudder 30. As a result, the rudder 30 automatically activates downwardly due to biasing of the biasing member 162 when the ice rescue craft 10 is in water. Conversely, the rudder 30 automatically folds upwardly about the pivot point (that is, the fastener 158) when the ice rescue craft 10 is on ice or land.

Stabilizer bars 164, or raft locking poles, enclose a periphery of the forward and aft raft sections 24 and 28. The locking poles 164 have two functions. First, the locking poles 164 prevent the forward and aft raft sections 24 and 28 from folding up or down during operation. Second, the locking poles 164 extend a portion of a hand rail from forward to aft of the rescue craft 10.

Referring additionally to FIG. 5, a the forward portion 152 of the aft raft section 28 defines a hinge point having the receptacles 150 that are sized and spaced to mate with the protrusions 146 provided at the hinge point on the after portion 148 of the forward raft section 24. When the forward and after raft sections 24 and 28 are folded out to their in-use position and deployed, the protrusions 146 are matingly received within the receptacles 150. This configuration helps ensure that the forward and aft raft sections 24 and 28 do not shift when the raft locking poles 164 are fastened.

The aft raft section 28 suitably is made of the same materials and has the same sprayed-on liner as the forward raft section 24.

Referring now to FIGS. 1–5 and 10, a pair of wheels 166 is provided on the aft raft section 28. The wheels 166 advantageously provide for ease of transport and assembly for use.

Referring now to FIGS. 1–5, transport and assembly of the rescue will now be explained. The drive unit 14 rests on top of the rescue craft 10 when the rescue craft 10 is folded for transport. A strap (not shown) holds the drive unit 14 to the rest of the rescue craft 10 when folded. The strap is released, and the drive unit 14 is lifted off the rescue craft 10 and positioned in front of the rescue craft 10. While the rescue craft 10 is still folded, the rescue craft 10 is stood on the forward portion 118 of the forward raft section 24. The aft raft section 28 is pulled out, thereby pulling apart the rescue craft 10. The stabilizer bars 164 are clipped to eye bolts (not shown) on the aft raft section 28. Pole locks (not shown) are twisted, thereby securing the stabilizer bars 164.

The drive unit 14 is attached as follows. The drive unit 14 is rolled back to the rescue craft 10. The lock pin 46 (FIG. 6) is placed in the hole 133 (FIG. 9) in the lock pin plate 132 (FIG. 9). The lock handle rod 140 (FIG. 9) is pulled, thereby allowing the lock pin 46 to drop into the lock fork 138 (FIG. 9). The lock handle rod 140 is released, thereby locking the lock pin 46 in the lock fork 138 and, as a result, locking the drive unit 14 to the rest of the rescue craft 10.

The outrigger pontoons 26 are pushed out and away from the sides of the forward raft section 24. The outrigger pontoons 26 automatically lock in the down position. The rescue craft 10 is now ready for use. An operator 167 (shown in phantom in FIG. 1) kneels with his or her shins on a deck on top of the forward raft section 24 while sitting upon a seat 169 (FIG. 1). The operator 167 steers the rescue craft 10 with the handle 42 and operates any installed control and safety electronics via the control panel 39 (FIG. 2).

Figure 11:
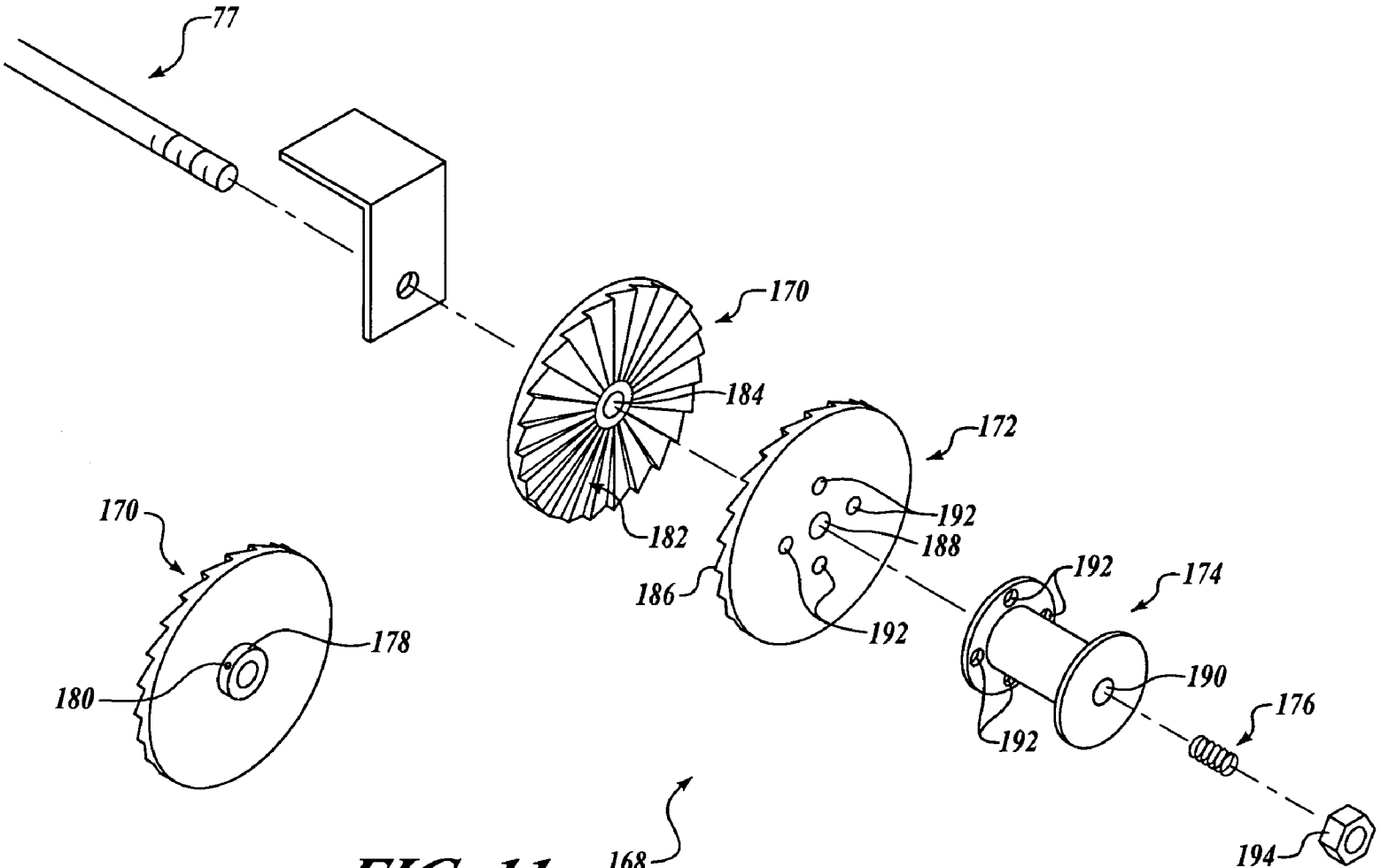

Referring now to FIG. 11, an optional winch 168 may be attached to the axle 77 (FIG. 7A), if desired. In this embodiment, the axle 77 extends a sufficient amount outboard the rescue craft 10, such as without limitation by around ten inches or so. Advantageously, the winch 168 may be used to pull a victim to the rescue craft 10 in the event the rescue craft 10 is unable to safely arrive at a victim's location. The winch 168 may be used with the rescue craft 10 configured for use or configured for transport. The winch 168 includes a fixed axle gear 170, a hub gear 172, a rescue line spindle 174, and an axle spring 176. The fixed axle gear 170 includes a collar 178 with a set screw 180 protruding therethrough. Teeth 182 of the fixed axle gear 170 are cut into a face of the gear 170 from a perimeter of the gear 170 toward a centered hole 184. In one non-limiting example, the teeth 182 are cut at an angle of around 22½ degrees, but the teeth 182 may be cut at any desired angle. The hub gear 172 also defines teeth 186 that are cut at the same angle as the teeth 182. The fixed axle gear 170 is slid onto the axle 77 such that the teeth 182 face away from the rescue craft 10. The set screw 180 is tightened, thereby securing the fixed axle gear 170 to the axle 77. The hub gear 172 and the rescue line spindle 174 define centered holes 188 and 190, respectively. The hub gear 172 and the rescue line spindle are attached to each other in any desired manner, such as by welding or by use of fasteners (not shown) such as bolts that are inserted through holes 192, such that the teeth 186 face away from the rescue line spindle 174. The hub gear 172 and the rescue line spindle 174 are placed onto the axle 77 such that the teeth 186 can engage the teeth 182. The rescue line spindle 174 suitably is a basic line spool for housing rescue line. The spring 176 is placed onto the axle 77 and is held in place with an end lock nut 194.

Because the gears 170 and 172 are placed face-to-face such that the teeth 182 engage the teeth 186, the gears 170 and 172 only turn and lock together in one direction. Turning the gears 170 and 172 in the other direction allows the faces of the gears 170 and 172 to push themselves apart, thereby permitting the gears 170 and 172 to turn independently. Biasing or urging by the spring 176 along with mating of the teeth 182 and 186 allow the gears 170 and 172 to turn in their lock position by way of pressure against the gear faces when the axle 77 is turned n one direction. The action of the spring 176 and the mating of the teeth 182 and 186 also permits the gears 170 and 172 to push away from each other and turn independently when they are turned in the opposite direction.

When the rescue craft 10 is set up on ground, the winch 168 can be used by raising the drive wheel 16 (FIGS. 1–3) off the ground and turning the drive wheel with the electric motor as described above. The drive wheel 16 can be raised off the ground in any acceptable manner. In one exemplary embodiment, the pontoons 50 (FIG. 6) can be fitted with extended mounting tubes that cause the drive wheel 16 to be raised off the ground when the pontoons 50 are locked in an extended position. Alternately, the winch 168 can be used when the rescue craft 10 is folded and strapped together for transport (see FIGS. 4 and 5). For example, the rescue craft 10 can be placed in a vehicle bed or on a trailer. The vehicle or trailer can be driven or otherwise moved to a desired location and the drive wheel 16 can be actuated to operate the winch 168 as described above. Advantageously, given by way of non-limiting examples, an operator can back up a vehicle or trailer to water, ice, a cliff, a ravine, or the like, and pull or lift a victim from the elements to safety.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A portable ice rescue craft comprising:

a plurality of foldable locking raft sections including at least a drive unit and an aft raft section;

a drive wheel attached to the drive unit, the drive wheel being drivable by an electric motor via a drive belt; and a pair of rudders are mounted outboard an after portion of the aft raft section, the pair of rudders being pivotably biased such that the rudders automatically fold upwardly when the ice rescue craft is on at least one of ice and land and the rudders automatically activate downwardly when the ice rescue craft is in water.

2. The rescue craft of claim 1, further comprising a forward raft section interposeable between the drive unit and the aft raft section.

3. The rescue craft of claim 2, wherein the forward raft section includes a pair of outrigger pontoons.

4. The rescue craft of claim 1, wherein the drive wheel includes a plurality of spikes configured to engage ice.

5. The rescue craft of claim 4, wherein the drive wheel further comprises a plurality of paddles that are centripetally urgeable outward.

6. The rescue craft of claim 1, further comprising a pair of pontoons disposed outboard the drive unit.

7. The rescue craft of claim 6, further comprising a winch drivable by the electric motor via the drive belt.

8. A portable ice rescue craft comprising:

a plurality of foldable locking raft sections including:

a drive unit;

an aft raft section; and a forward raft section interposeable between the drive unit and the aft raft section;

a drive wheel attached to the drive unit, the drive wheel being drivable by an electric motor via a drive belt, the drive wheel including:

a plurality of spikes configured to engage ice; and a plurality of paddles that are centripetally urgeable outward; and a pair of rudders mounted outboard an after portion of the aft raft section, the pair of rudders being pivotably biased such that the rudders automatically fold upwardly when the ice rescue craft is on at least one of ice and land and the rudders automatically activate downwardly when the ice rescue craft is in water.

9. The rescue craft of claim 8, wherein the forward raft section includes a pair of outrigger pontoons.

10. The rescue craft of claim 8, further comprising a pair of pontoons disposed outboard the drive unit.

11. The rescue craft of claim 10, further comprising a winch drivable by the electric motor via the drive belt.

12. The rescue craft of claim 8, wherein an after portion of the drive unit is azimuthally pivotable about a forward portion of the forward raft section.

13. A portable ice rescue craft comprising:

a plurality of foldable locking raft sections including:

a drive unit;

an aft raft section; and a forward raft section interposeable between the drive unit and the aft raft section;

a drive wheel attached to the drive unit, the drive wheel being drivable by an electric motor via a drive belt, the drive wheel including:

a plurality of spikes configured to engage ice; and a plurality of paddles that are centripetally urgeable outward;

a first pair of pontoons disposed outboard the drive unit;

a second pair of pontoons disposed outboard the forward raft section; and a pair of rudders mounted outboard an after portion of the aft raft section.

14. The rescue craft of claim 13, wherein the pair of rudders are pivotably biased such that the rudders automatically fold upwardly when the ice rescue craft is on at least one of ice and land and the rudders automatically activate downwardly when the ice rescue craft is in water.

15. The rescue craft of claim 13, further comprising a winch drivable by the electric motor via the drive belt.

16. The rescue craft of claim 13, wherein an after portion of the drive unit is azimuthally pivotable about a forward portion of the forward raft section.

* * * * *